United States Patent [19]

Gambill

[11] 4,083,682

[45] Apr. 11, 1978

[54] METHOD FOR PRODUCING VARIEGATED NYLON YARN

[75] Inventor: Richard L. Gambill, Hope Mills, N.C.

[73] Assignee: Rohm and Haas Company, Philadelphia, Pa.

[21] Appl. No.: 654,838

[22] Filed: Feb. 3, 1976

Related U.S. Application Data

[63] Continuation-in-part of Ser. No. 451,265, Mar. 14, 1974, abandoned.

[51] Int. Cl.[2] ..... D06P 3/04; D06P 5/12; D06P 5/22

[52] U.S. Cl. ..... 8/15; 8/65; 8/88; 8/171; 8/173

[58] Field of Search ..... 8/88, 15, 65, 171, 173

[56] References Cited

U.S. PATENT DOCUMENTS

| | | | |
|---|---|---|---|
| 3,449,057 | 6/1969 | Ward | 8/15 |
| 3,724,997 | 4/1973 | Von Der Elitz et al. | 8/14 |
| 3,743,477 | 7/1973 | Egli et al. | 8/66 |
| 3,775,045 | 11/1973 | Buehler et al. | 8/15 |
| 3,926,548 | 12/1975 | Moriyama et al. | 8/1155 |
| 3,986,235 | 10/1976 | Norris | 28/74 P |

*Primary Examiner*—John Kight, III

[57] ABSTRACT

Variably dyed nylon yarn is produced by nonuniformly applying to the yarn a reagent effective to alter the affinity of the portions of yarn so treated to a dyestuff, followed by dyeing of the yarn with the dyestuff.

6 Claims, 5 Drawing Figures

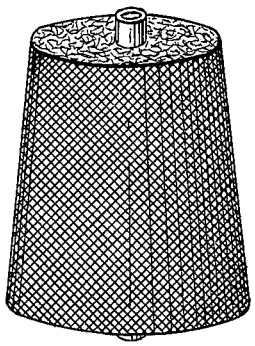
FIG. I
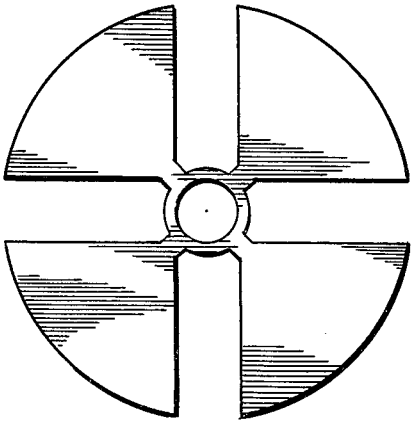
FIG. II
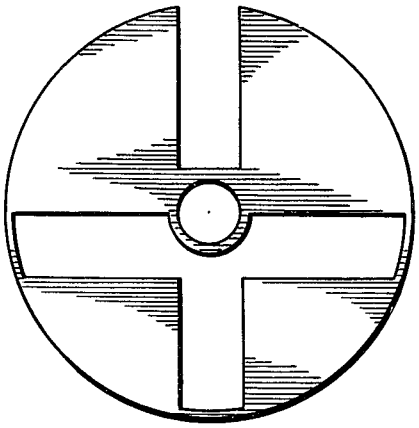
FIG. III
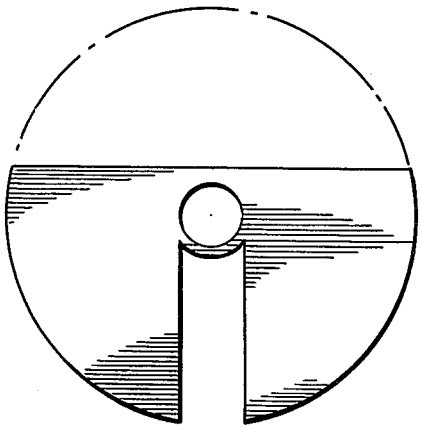
FIG. IV
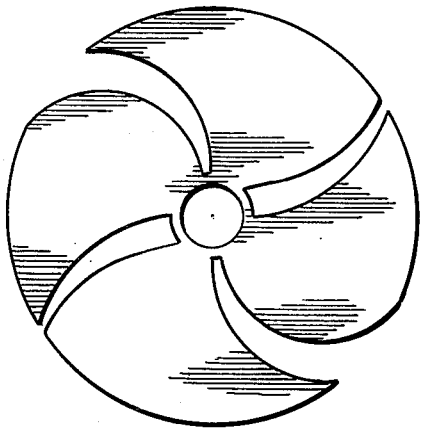
FIG. V

METHOD FOR PRODUCING VARIEGATED NYLON YARN

This application is a continuation-in-part of application Ser. No. 451,265, filed Mar. 14, 1974 and abandoned as of the filing date accorded this application.

This invention relates to a new method for producing variably-dyed nylon yarn.

Attempts have been made to achieve a variegated yarn effect by the use of dyeing, padding and printing but the method requires several operations and results in a substantial increase in the cost of the resulting fabric.

According to this invention, a high quality, variegated effect can be achieved in nylon yarns by treating the yarn, preferably in spools thereof, with a yarn-modifying reagent. The reagent chemically alters the nylon and, as a result, changes its affinity for dyestuffs. Once the nylon yarn has been treated in this manner, the effect is built into the yarn, and when it is dyed and tufted into carpeting or made into fabrics in the conventional manner, there is produced various lengths of variably dyed portions which give the appearance of random streaks.

In one mode of practice, I have found that the desired effect can be achieved by simply placing a mask such as a template of the type depicted in FIGS. II, III, IV or V over one or both ends of the tube of a spooled nylon yarn package (FIG. I). The reagent is applied in solution to the yarn through the template openings by the use of a dropper, squeeze bottle, spray gun or other functionally equivalent means. If no template is used the solution is permitted to distribute itself over the entire length of the spool; however, a template may also be placed over the opposite end of the spool and the solution applied through the template openings.

The template design will determine, to a large extent, the color pattern on the resulting fabric.

Essentially, the templates of FIGS. II-V afford the following color patterns:

FIG. II: produces random lengths of streaking ranging from 0.25 inch to about 10 inches with the number of lengths increasing towards the center of the package;

FIG. III: also gives random lengths ranging from 0.25 inch to about 10 inches but the frequency of the streaking remains more constant from the outside of the spool to the inside;

FIG. IV: produces streak lengths from 0.25 inch to about 20 inches with greater variability between lengths than occurs with the templates of FIGS. I or II;

FIG. V: gives random lengths which alternate from 0.25 inch to about 10 inches.

When no template is used and the solution is applied to both ends of the spooled yarn there is produced random lengths ranging from about 2 inches to about 20 inches; up to approximately 45% of the yarn is treated depending on the amount of the solution applied to the package the type of package, and the denier of the yarn, e.g., whether the yarn is a two-ply yarn of 2600 denier per ply or a two-ply yarn of 1300 denier per ply in an eight pound spooled package. The greater the total denier and weight of package, the more solution required to obtain the variegated effect.

In those instances where the objective is to produce longer lengths of streaking, I have found that the templates of FIGS. IV or no template afford the best results. Of course, the templates applied to either side of the package may have different designs so as to afford varied patterns.

Prior to the application of the yarn-modifying reagent, the spooled yarn may be textured and/or twisted and/or heat set according to conventional means. The yarn may be textured by knife-edge crimping, stuffer box, air jet or gear crimping, all as known to the art. The yarn is then treated with the reagent via the use of one of the templates depicted in FIGS. II–V and then dyed and finished. It is after the dyeing step has been completed that the variegations will become prominently visible.

In general, commercially availabe water-soluble dyes and art recognized dyeing conditions can be used to achieve the variegated effect. Suitable dyes include Merpacyl Yellow 4G (color index acid yellow 174); Nylosan Red M-RL pat. (color index acid red) and Pyrazol Fast Blue BC (color index direct blue 71). Dyes which contain more than one sulfonic acid group per molecule, the so-called polysulfonated dyes, promote higher contrast between the light and dark areas than do the monosulfonated structures. However, the contrast level can also be adjusted by varying the dye bath pH. For example, some dyestuffs will yield a higher contrast if the dye bath pH is kept between 9.0 and 7.0 than if the pH is maintained between 6.0 and 6.2.

The process is exemplified using a nylon fiber reacted with acid dyes but this is for illustration only; it is understood that the nylon yarn can be treated with basic dyes with corresponding changes in the dye protective reagent.

The reagent used to treat the nylon yarn may vary widely. If the reagent is normally a solid, it will be used in solution, i.e., dissolved or dispersed in a suitable solvent or dispersion medium. If a liquid, the reagent may be used neat. Typical of useful reagents are reserving compounds of the organic and inorganic acids of the carboxylic acid, sulfonic acid and phosphonic acid variety as, for example, halotriazine sulfonic acids or salts of U.S. Pat. No. 3,743,477 or p-aminobenzene sulfonic acid and the like. The disclosure of U.S. Pat. No. 3,743,477 is incorporated herein by reference. The precise nature of the reaction which occurs upon treating the nylon with the reagent is not certain but it would seem that it reacts with the amino end group of the caprolactam molecule comprising the nylon. Apparently, this reaction masks the amino end group and eliminates it as a possible dye site for acid dyes, i.e., dyes containing acid groups such as sulfonic acid groups.

It has also been found that the variegated effect in the finished product can be enhanced by employing reagents which, in addition to an acid group, contain a lower polyhaloalkyl moiety such as polyhalomethyl as, for example, trichloromethyl or trifluoromethyl and the like, or a lower polyhalocycloalkyl group such as 2,3-dichlorocyclopropyl and the like. Such polyhalogenated moieties have an affinity for basic dyes and, therefore, the presence of such moieties on the caprolactam molecule will serve to attract basic dyes and result in a product having good color contrast.

According to one embodiment of this invention, a 3% to 5% aqueous solution of a halotriazine sulfonate and, preferably, a 4% solution, is prepared and the pH of the solution maintained in the range of from 5.5 to 7.0 and preferably 6.5 to 6.7. The solution is then applied to the spooled package through a suitable template such as the template of FIG. III or IV and the resulting treated material is then permitted to come to equilibrium by maintaining it at approximately 65° F. for a suitable period of time. Thereafter, the yarn is dyed according to conventional means.

Thus, a preferred embodiment of this invention consists in using a solution of a halotriazine sulfonic acid or sulfonic acid salt as the yarn modifier; however, it is to be understood that other functionally equivalent reagents may also be employed.

The yarns employed in this invention may be undrawn, partially drawn, crimped, twisted and/or textured as, for example, crimped yarn or yarn which has been textured and heat set by conventional means.

The amount of yarn-modifying reagent applied to the spooled yarn through the template openings will vary depending upon the type of reagent employed and the effect which it is desired to achieve. However, in general, about 20 milliequivalents (meq) of reagent per kilogram weight of nylon will be effective. To achieve a satisfactory effect, at least about 10% and up to a maximum of 100% of the spooled yarn and, preferably, 60–100% of the yarn surface area at the ends of the spool, is contacted with the reagent. Of course, it will be appreciated that lower or higher amounts of reagents can be used depending upon the effect which it is desired to achieve. Studies indicate that the application of a total of 20 meq of a halotriazine sulfonate sold under the brand name "Sandospace R" per kilogram of nylon yarns from both ends of the spool, using a template of the type described in FIGS. IV and/or V, is particularly suitable for obtaining consistent striations in the finished fabric The following examples illustrate this invention and are presented by way of description and not by way of limitation.

EXAMPLE 1

Step A: Modifier Treatment

A template of the type described in FIG. III was placed over the end of the nylon yarn spool of FIG. I facing up. Using a dropper, or other dispensing means such as a spray gun, 250 ml. of a 4% solution (9.8 meq.) "Sandospace R" (brand name for a compound within the scope of U.S. Pat. No. 3,743,477 and believed to be sodium 2,4-dichloro-6-phenylamino-1,3,5-triazine-4'-sulfonate), was applied through the template. The solution was permitted to distribute itself through the entire length of the yarn as observed through the template openings.

Following the treatment of one end of the spooled yarn the template of FIG. III was placed over the opposite end and the solution was applied in the same manner as described in the previous paragraph. The yarn thus treated was then dyed according to the procedure described in Step B.

Step B: Dyeing

This procedure illustrates the application of 0.35% dyestuff to afford a tone on white dyed nylon yarn exhibiting good contrast and fastness.

The dye bath was set at 100° F. with 2.5% on fabric weight of a suitable leveling agent such as Lyogen SMK 40. The pH was adjusted to 9.0–9.5 with 1% of a 28% ammonia solution, 0.5–2.0% tetrasodium pyrophosphate and 0.5–1.5% monosodiumphosphate. The yarn was agitated for 5 minutes and a dyestuff solution consisting of 0.35% sulphonine Acid Blue R was added. The mixture was heated to the boil in 40 minutes and the temperature was maintained for 60 minutes. The dye bath was then diluted by adding cold water to 160° F. The dyed yarn was rinsed in cold water, extracted and dried to afford a yarn having a white and blue striated effect.

EXAMPLE 2

Step A: Modifier Treatment

A template of the type described in FIG. IV was placed over the end of a nylon yarn spool. Using a spray gun, 320 ml. of a 4% solution of "Sandospace R" (12.5 meq) was aplied through the template. The solution was permitted to distribute itself through the entire length of the yarn as observed through the template openings.

Following the treatment of one end of the spooled yarn, the template of FIG. IV was then placed over the opposite end and the "Sandospace R" solution applied in the same manner as described in the previous paragraph. The yarn thus treated was then dyed according to the procedure described in Step B of Example 1.

Step B: Dyeing

This procedure illustrates the application of a combination of acid and basic (cationic) dyes.

The dye bath is set at 100° F. with 2.5% of a suitable leveling agent and 1.0% monosodiumphosphate to obtain a pH of 6.0–6.2.

The yarn is agitated in the bath for 5 minutes after which a dyestuff mixture is added consisting of 0.05% Sandocryl Blue B-2GLE pat and 0.5% Merpacyl Yellow 4G. The temperature of the bath is then raised to the boil in 40 minutes and maintained at the boil for 60 minutes. The dye bath is diluted by adding cold water. The dyed yarn is thereafter rinsed in cold water, extracted and dried to afford a yarn having a yellow and blue striated effect.

Unless otherwise stated, all parts and percentages throughout the specification and claims are by weight. In the Examples, the weight of the starting, untreated yarn on the cone in each instance was 8.5 lbs. or 3.85 kilograms.

What is claimed is:

1. A method for producing a variably dyed nylon yarn which comprises non-uniformly applying a reagent to one or both ends of a spool of said yarn, said reagent being effective to alter the affinity of the portions of the yarn so treated to a dyestuff, followed by dyeing of the yarn with the dyestuff.

2. A method as in claim 1 wherein the reagent is applied to said spool of yarn through a template placed over at least one end of said spool.

3. A method as in claim 1 wherein the reagent is selected from carboxylic acids, sulfonic acids, phosphonic acids and salts thereof.

4. A method as in claim 1 wherein the reagent is a halotriazine sulfonic acid or salt thereof.

5. A method as in claim 1 wherein the reagent is applied in an amount of about 1–50 milliequivalents of reagent per 1 kilogram of yarn.

6. A method as in claim 1 wherein the yarn is textured before application of the reagent.

* * * * *